US005104780A

United States Patent [19]

Sugita et al.

[11] Patent Number: 5,104,780

[45] Date of Patent: Apr. 14, 1992

[54] LIGHT-SENSITIVE SILVER HALIDE COLOR PHOTOGRAPHIC MATERIAL CONTAINING NON-DIFFUSION COUPLER/1-PHENYL-3 PYRAZOLIDONE DERIVATIVE

[75] Inventors: Shuichi Sugita; Shuji Kida; Hidenobu Ohya, all of Hino, Japan

[73] Assignee: Konica Corporation, Tokyo, Japan

[21] Appl. No.: 610,086

[22] Filed: Nov. 7, 1990

[30] Foreign Application Priority Data

Nov. 22, 1989 [JP] Japan ..... 1-302003

[51] Int. Cl.[5] ..... G03C 7/305

[52] U.S. Cl. ..... 430/543; 430/553; 430/555; 430/557; 430/558; 430/380; 430/955; 430/959

[58] Field of Search ..... 430/543, 544, 549, 558, 430/955, 959, 960, 553, 555, 557, 380

[56] References Cited

U.S. PATENT DOCUMENTS 4,421,845 12/1983 Uemura et al. ..... 430/553
4,859,578 8/1989 Michno et al. ..... 430/544
4,861,701 8/1989 Burns et al. ..... 430/543

FOREIGN PATENT DOCUMENTS 2044338 2/1990 Japan ..... 430/544
2096783 10/1982 United Kingdom .

*Primary Examiner*—Charles L. Bowers, Jr.
*Assistant Examiner*—Lee C. Wright
*Attorney, Agent, or Firm*—Frishauf, Holtz, Goodman & Woodward

[57] ABSTRACT

There is disclosed a light-sensitive silver halide photographic material which comprises containing a compound having a group at 4-position of a pyrazole ring, and having a residue of non-diffusion type coupler through an oxygen atom, a sulfur atom or an imino group at the 5-position of the same, wherein A represents a residue of 1-phenyl-3-pyrazolidone derivatives and p is 0 or 1.

13 Claims, No Drawings

LIGHT-SENSITIVE SILVER HALIDE COLOR PHOTOGRAPHIC MATERIAL CONTAINING NON-DIFFUSION COUPLER/1-PHENYL-3 PYRAZOLIDONE DERIVATIVE

BACKGROUND OF THE INVENTION

This invention relates to a silver halide color photographic material which is excellent in coloring property and graininess and less in fog.

A light-sensitive silver halide color photographic material has been improved variously and, in recent years, those having excellent sensitivity, less in fog, good graininess and color reproducibility can be obtained. Among these, in Japanese Provisional Patent Publication No. 113060/1986 and U.S. Pat. No. 4,859,578, a compound wherein a coupling portion of a coupler is replaced directly or through a timing group by a residue of 1-phenyl-3-pyrazolidone derivatives is disclosed. However, these are each poor in coloring property so that sensitivity, gamma and color density are also poor and graininess is also not reached to a sufficient level.

SUMMARY OF THE INVENTION

An object of the present invention is to overcome the above problems and to provide a light-sensitive silver halide color photographic material which has high sensitivity, high gamma value, high color density and also excellent in graininess, and further preventing fog.

The above object of the present invention can be accomplished by a light-sensitive silver halide color photographic material having the following constitution.

That is, the light-sensitive silver halide color photographic material of the present invention comprises containing a compound having a

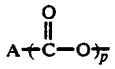

group at 4-position of a pyrazole ring, having a residue of a non-diffusion type coupler through an oxygen atom, a sulfur atom or an imino group at the 5-position of the same, wherein A represents a residue of 1-phenyl-3-pyrazolidone derivatives and p is 0 or 1, (hereinafter sometimes referred to as "the compound according to the present invention").

More specifically, the compound of the present invention is represented by the formula shown below.

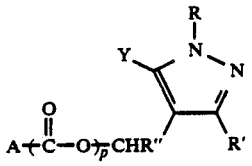

(Q)

wherein R represents a hydrogen atom, an alkyl group, an alkoxy group, an aryl group, an acyl group, a sulfonyl group, an alkoxycarbonyl group or a heterocyclic group; R' represents a hydrogen atom, an alkyl group, an aryl group, an alkoxy group, an amino group, an amide group, a sulfonamide group, a carboxyl group, an alkoxycarbonyl group, a carbamoyl group or a cyano group; R" represents a hydrogen atom or a phenyl group; A represents a residue of 1-phenyl-3-pyrazolidones; Y represents a residue of a non-diffusion type coupler bonded through an oxygen atom, a sulfur atom or an imino group; and p is 0 or 1.

DESCRIPTION OF THE PREFERRED EMBODIMENTS

In the following, the present invention will be described in more detail.

The compound to be used in the present invention has characteristics that a residue of the above non-diffusion type coupler and a residue of 1-phenyl-3-pyrazolidone derivatives are bound through an oxygen atom, a sulfur atom or an imino group bound at 5-position of a pyrazole nucleus and a

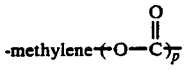

group bonded at 4-position of the same, respectively. By using such bonding groups, the above objects can be accomplished.

Said pyrazole ring contains those having substituents at 1-position and 3-position thereof, and as the substituent at the 1-position thereof, there may be mentioned, for example, an alkyl group, an aryl group, an acyl group, a sulfonyl group, an alkoxycarbonyl group and a heterocyclic group. As the substituent at the 3-position of the same, there may be mentioned, for example, an alkyl group, an aryl group, an alkoxy group, an amino group, an amido group, a sulfonamido group, a carboxyl group, an alkoxycarbonyl group, a carbamoyl group and a cyano group.

Also, the methylene group in the

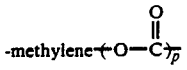

contains those having a substituent(s), and such substituents may include, for example, an alkyl group and an aryl group. Further, when the pyrazole nucleus binds to a residue of the non-diffusion type coupler through an imino group, said imino group contains those having a substituent(s). As the substituents, there may be mentioned, for example, an alkyl group, an aryl group, an acyl group and a sulfonyl group.

Each group exemplified by substituents for the 1-position and the 3-position of the aforesaid pyrazole nucleus, substituents for the methylene group and substituents for the imino group is explained below.

As the alkyl group, those having 1 to 32 carbon atoms are preferred, and more specifically, there may be mentioned a methyl group, an ethyl group, a propyl group, an isopropyl group, a t-butyl group, a 2-ethylhexyl group, a 3,5,5-trimethylhexyl group, an octyl group, a t-octyl group and a dodecyl group, and said alkyl group may be substituted by, a group such as a hydroxyl group, an alkoxy group, a halogen atom, an aryloxy group, a cyano group, an alkylthio group and an arylthio group.

As the aryl group, a phenyl group or a naphthyl group is preferred, and said aryl group may be substituted by a substituent having 0 to 5 carbon atoms. As such a substituent, there may be mentioned, for example, an alkyl group, a halogen atom, a hydroxy group, an alkoxy group, an amino group, an amido group, a sulfonamido group, a carboxyl group, an alkoxycarbonyl group, an acyl group, a carbamoyl group, a nitro group, a cyano group, a mercapto group, an alkylthio group a sulfonyl group, a sulfo group and a sulfamoyl group.

As the acyl group as the substituent for the 1-position of the pyrazole ring and the imino group, there may be mentioned an alkylcarbonyl group and an arylcarbonyl group, and said alkyl and aryl may include those having a substituent(s). As said substituent(s), those as exemplified by the substituents for the above alkyl group and aryl group may be mentioned.

As the sulfonyl group as the substituent for the 1-position of the pyrazole ring and the imino group, there may be mentioned an alkylsulfonyl group and an arylsulfonyl group, and said alkyl and aryl may include those having a substituent(s). As said substituent(s), those as exemplified by the substituents for the above alkyl group and aryl group may be mentioned.

As the heterocyclic group as the substituent for the 1-position of the pyrazole ring, there may be mentioned a group such as a furyl group, a pyranyl group, an imidazolyl group, a benzimidazolyl group, a pyrrolyl group, a pyrimidyl group, a triazinyl group, a thianyl group, a quinolyl group, an oxazolyl group, a benzoxazolyl group, a thiazolyl group and a benzthiazolyl group, and said heterocyclic group may include those having a substituent(s). As said substituent(s), those as exemplified by the substituents for the above aryl group may be mentioned.

As the amino group as the substituent for the 3-position of the pyrazole ring, there may be mentioned an amino group, a monoalkylamino group and a dialkylamino group, and said alkyl may include those having a substituent(s). As said substituent(s), those as exemplified by the substituents for the above alkyl group may be mentioned.

As the amido group as the substituent for the 3-position of the pyrazole ring, there may be mentioned an alkylcarbonylamino group and an arylcarbonylamino group, and as the sulfonamido group, there may be mentioned an alkylsulfonylamino group and an arylsulfonylamino group.

As the carbamoyl group, there may be mentioned a carbamoyl group, an alkylcarbamoyl group and an arylcarbamoyl group, and said alkyl and aryl may include those having a substituent(s). As said substituent(s), those as exemplified by the substituents for the above alkyl group and aryl group may be mentioned.

Also, the alkyl component in the alkoxycarbonyl group as the substituent for the 1- and 3-positions of the pyrazole ring, and the alkoxy group as the substituent for the 3-position of the pyrazole ring may include those having a substituent(s), and as said substituent(s), those as exemplified by the substituents for the above alkyl group may be mentioned.

As the residue of the non-diffusion type coupler through an oxygen atom, a sulfur atom or an imino group at the 5-position of the pyrazole ring, there may be mentioned a residue of the non-diffusive type coupler which forms a yellow, magenta or cyan dye and a residue of the non-diffusive type coupler which forms a substantially colorless product. Here, the residue of the non-diffusive type coupler means those eliminated a hydrogen atom at a coupling position of the tetra-equivalent non-diffusive type coupler.

Representative examples of the yellow coupler residue, there are described in U.S. Pat. Nos. 2,298,443, 2,407,210, 2,875,057, 3,048,194, 3,265,506 and 3,447,928; and Farbkuppler eine Literaturuversiecht Agfa Mittellung (Band II), pp. 112 to 126 (1961) and the like. Of these, acylacetoanilides such as benzoylacetanilide, and pyvaloylacetanilides are preferred.

Representative examples of the magenta coupler residue, there are described in U.S. Pat. Nos. 2,369,489, 2,343,703, 2,311,182, 2,600,788, 2,908,573 3,062,653, 3,152,896, 3,519,429, 3,725,067 and 4,540,654, Japanese Provisional Patent Publication No. 162548/1984, and the above Agfa Mittellung (Band II), pp. 126 to 156 (1961). Of these, pyrazolones or pyrazoloazoles such as pyrazoloimidazole and pyrazolotriazoles are preferred.

Representative examples of the cyan coupler residue, there are described in U.S. Pat. Nos. 2,367,531, 2,423,730, 2,474,293, 2,772,162, 2,395,826, 3,002,836, 3,034,892, 3,041,236 and 4,666,999, and the above Agfa Mittellung (Band II), pp. 156 to 175 (1961). Of these, phenols and naphthols are preferred.

Representative examples cf the coupler reside which forms a substantially colorless product are described in British Patent No. 861,138, U.S. Pat. Nos. 3,632,345, 3,928,041, 3,958,993 and 3,961,959. Of these, cyclic carbonyl compound is preferred.

As the yellow coupler residue, those represented by the following formula (I) and the formula (II) is preferred.

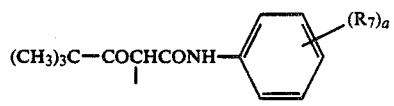

(I)

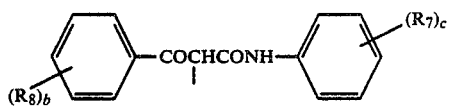

(II)

In the above formulae (I) and (II), $R_7$ and $R_8$ each represent an alkyl group, a cycloalkyl group, an aryl group and a heterocyclic group, or a halogen atom, said alkyl group, cycloalkyl group, aryl group and heterocyclic group may be bonded through an oxygen atom, a nitrogen atom or a sulfur atom. Further, said alkyl group, cycloalkyl group, aryl group and heterocyclic group may be bound through the following bound group. That is, there may be mentioned an acylamino group, a carbamoyl group, a sulfonamido group, a sulfamoyl group, a sulfamoylcarbonyl group, a carbonyloxy group, an oxycarbonyl group, a ureido group, a thioureido group, a thioamido group, a sulfonyl group and a sulfonyloxy group; and said alkyl, cycloalkyl, aryl and heterocyclic groups may include those having a substituent(s). As the substituent(s), there may be mentioned, for example, a halogen atom, a nitro group, a cyano group, an alkyl group, an alkenyl group, a cycloalkyl group, an aryl group, an alkoxy group, an aryloxy group, an alkoxycarbonyl group, an aryloxycarbonyl group, a carboxy group, a sulfo group, a sulfamoyl group, a carbamoyl group, an acylamino group, a ureido group, a urethane group, a sulfonamido group, a heterocyclic group, an arylsulfonyl group, an alkylsulfonyl group, an arylthio group, an alkylthio group, an alkylamino group, an anilino group, a hydroxy group, an imido group and an acyl group. a represents an integer of 1 to 5, b and c each represent an integer of 0 to 5, and when a, b and c are 2 or more, $R_7$'s or $R_8$'s may be the same or different from each other.

As the magenta coupler residue, those represented by the following formulae (III), (IV), (V) and (VI) are preferred.

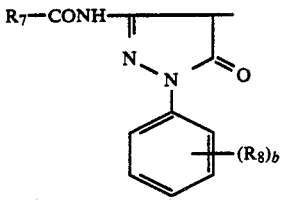
(III)

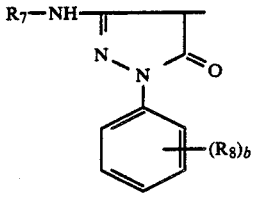
(IV)

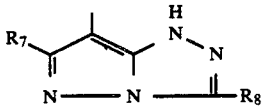
(V)

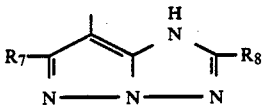
(VI)

In the above formula (III) to formula (VI), $R_7$, $R_8$ and b have the same meanings as $R_7$, $R_8$ and b in the formula (I) and formula (II), respectively.

As the cyan coupler residue, those represented by the following formulae (VII), (VIII) and (IX) are preferred.

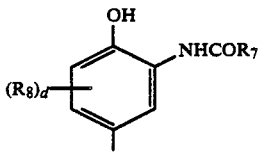
(VII)

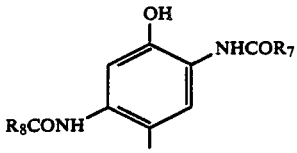
(VIII)

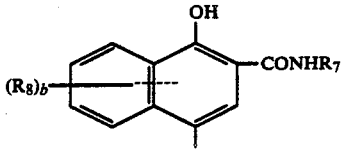
(IX)

In the above formula (VII) to formula (IX), $R_7$, $R_8$ and b have the same meanings as $R_7$, $R_8$ and b in the formula (I) and formula (II), respectively. d represents an integer of 0 to 3, and when d is 2 or more, each $R_8$ may be the same or different.

As the coupler residue forming a substantially colorless product, those represented by the following formulae (X) to (XIII) are preferred.

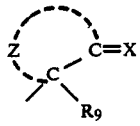
(X)

In the formula, $R_9$ represents a hydrogen atom, an alkyl group, an aryl group, a halogen atom, an alkoxy group, an acyloxy group or a heterocyclic group; X represents an oxygen atom or $=N-R_{10}$, where $R_{10}$ represents an alkyl group, an aryl group, a hydroxy group, an alkoxy group or a sulfonyl group; Z represents a non-metallic atom group necessary for forming a 5- to 7-membered carbon ring (a monocyclic ring such as indane, cyclopentane and cyclohexane, or a heterocyclic ring such as pyperidine, pyrrolidine and hydrocarbostyryl), and said carbon ring may contain those wherein a carbon ring or heterocyclic ring is further fused or those having a substituent(s).

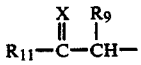
(XI)

In the formula, $R_9$ and Z have the same meanings as $R_9$ and X in the formula (X), respectively; and $R_{11}$ represents an alkyl group, an aryl group, a heterocyclic group, a cyano group, a hydroxy group, an alkoxy group, an aryloxy group, a heterocyclicoxy group, an alkylamino group, a dialkylamino group or an anilino group.

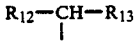
(XII)

In the formula, $R_{12}$ and $R_{13}$ each represent an alkoxycarbonyl group, a carbamoyl group, an acyl group, a cyano group, a formyl group, a sulfonyl group, a sulfinyl group, a sulfamoyl group, an ammonium group or

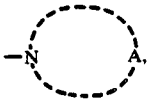

where A represents a non-metallic atom group necessary for forming a 5- to 7-membered heterocyclic ring (e.g. phthalimido, triazole and tetrazole) with a nitrogen atom.

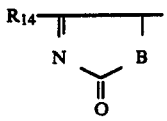
(XIII)

In the formula, $R_{14}$ represents an alkyl group, an aryl group, an anilino group, an alkylamino group or an alkoxy group; and B represents an oxygen atom, a sulfur atom or a nitrogen atom.

It is preferred that at least one of $R_7$ in number of a in the formula (I), at least one of $R_8$ in number of b and $R_7$ in number of c in the formula (II), at least one of $R_7$ and $R_8$ in number of b in the formula (III), formula (IV) and formula (IX), at least one of $R_7$ and $R_8$ in the formula (V), formula (VI) and formula (VIII), at least one of $R_7$ and $R_8$ in number of d in the formula (VII), at least one substituent possessed by a carbon ring formed by $R_9$ and Z in the formula (X), at least one of $R_9$ and $R_{11}$ in the formula (XI), at least one of $R_{12}$ and $R_{13}$ in the formula (XII), and $R_{14}$ in the formula (XIII) are groups having 8 or more carbon atoms.

1-Phenyl-3-pyrazolidones in the compounds according to the present invention include their tautomers (e.g. 1-phenyl-3-hydroxy-2-pyrazolines).

As the 1-phenyl-3-pyrazolidones, those represented by the following formula (P-1) and the formula (P-2) are preferred.

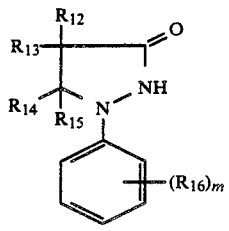

(P-1)

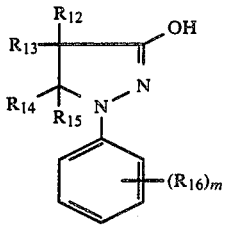

(P-2)

In the formulae, $R_{12}$ to $R_{15}$ each represent a hydrogen atom, an alkyl group or an aryl group. $R_{16}$ represents a halogen atom, an alkyl group or an alkoxy group. m is an integer of 0 to 4, and when $m \geqq 2$, each $R_{16}$ may be the same or different.

Among $R_{12}$ and $R_{13}$, preferred are a hydrogen atom and an alkyl group, and they are alkyl groups, those having 1 to 3 carbon atoms are more preferred. Such alkyl groups may include those having a substituent(s) such as a hydroxy group.

Among $R_{14}$ and $R_{15}$, preferred is a hydrogen atom.

The alkyl group represented by $R_{12}$ to $R_{16}$, the aryl group represented by $R_{12}$ to $R_{15}$ and the alkoxy group represented by $R_{16}$ may include those having a substituent(s) (e.g. a hydroxy group).

A residue of 1-phenyl-3-pyrazolidones represented by A is a group in which a hydrogen is removed from 1-phenyl-3-pyrazolidones, and preferred are those in which a hydrogen atom at 2-position of a pyrazolidine ring in the formula (P-1) and those in which a hydrogen atom of a hydroxy group which is a substituent at 3-position of 2-pyrazoline ring in the formula (P-2), and particularly preferably the former.

In the following, representative examples of the formula (Q) according to the present invention are shown, but the present invention is not limited by these.

1.

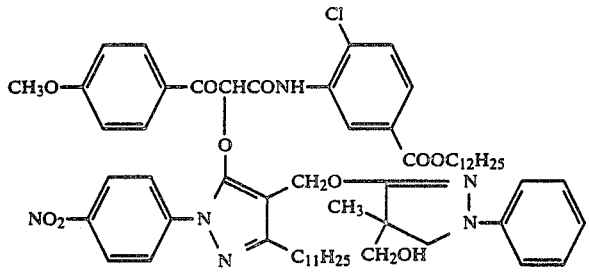

2.

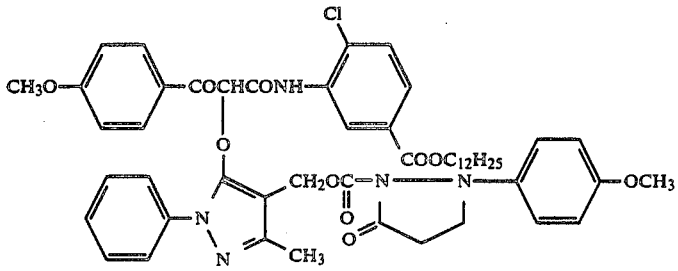

-continued
3.
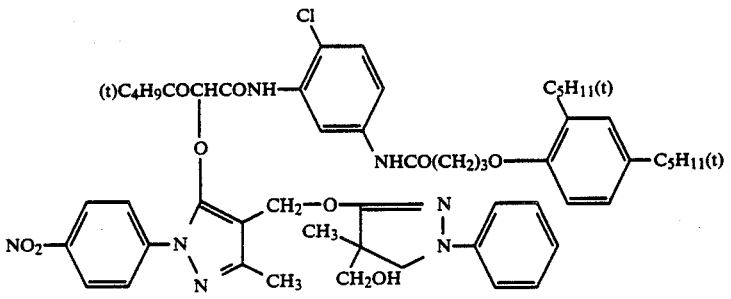
4.
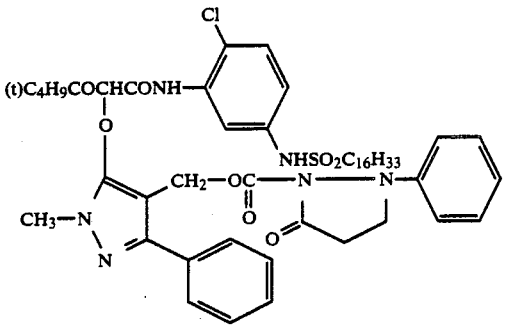
5.
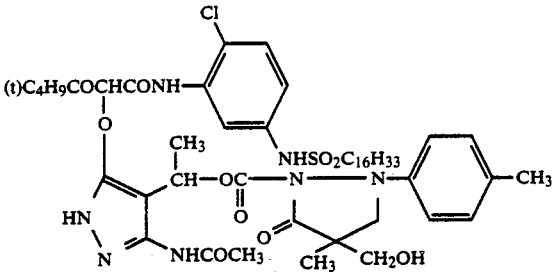
6.
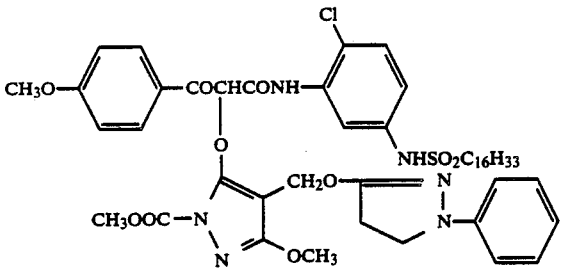
7.
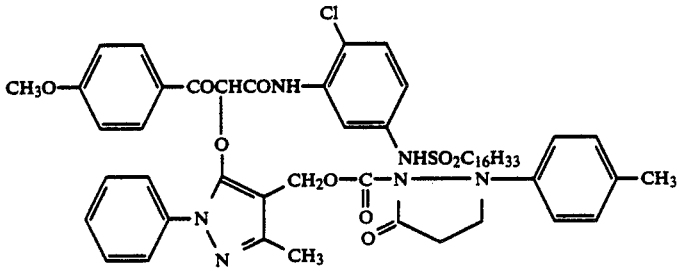

-continued
8.
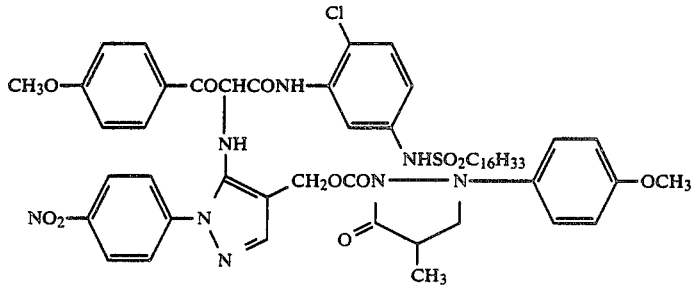
9.
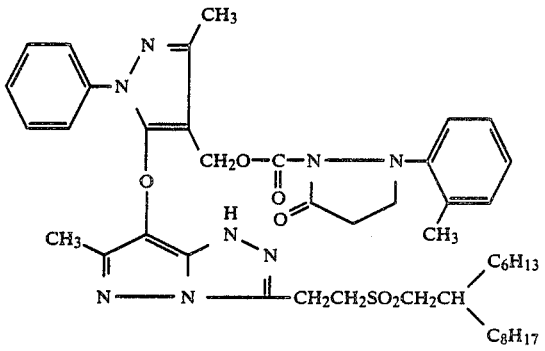
10.
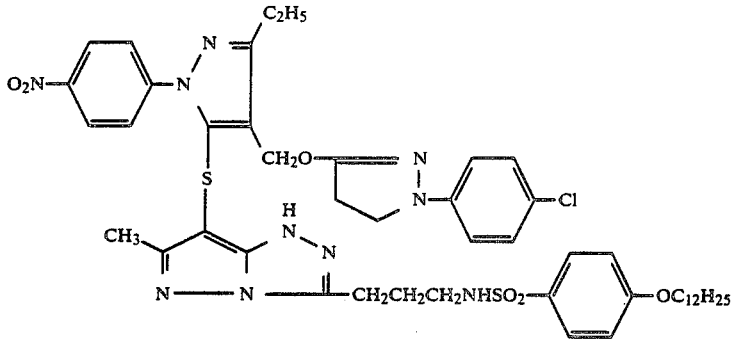
11.
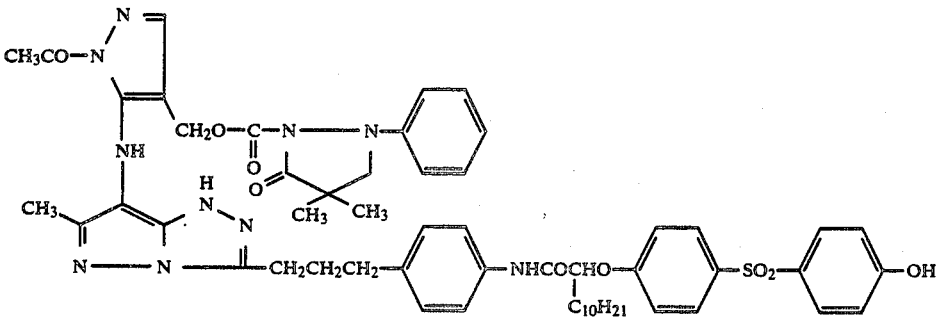

-continued
12.
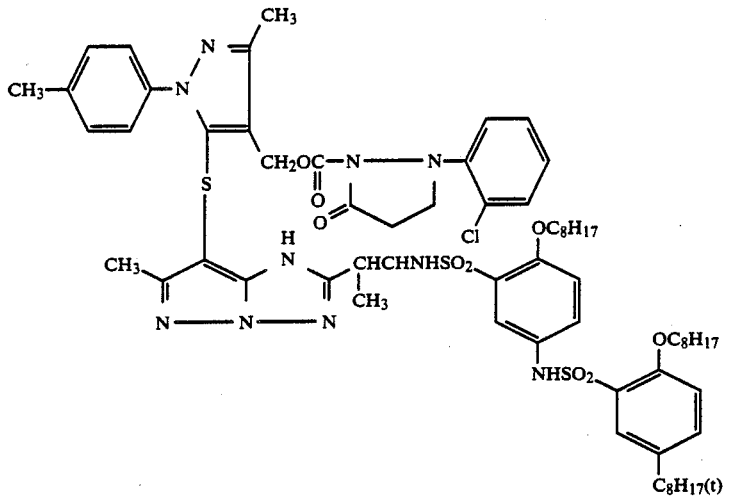
13.
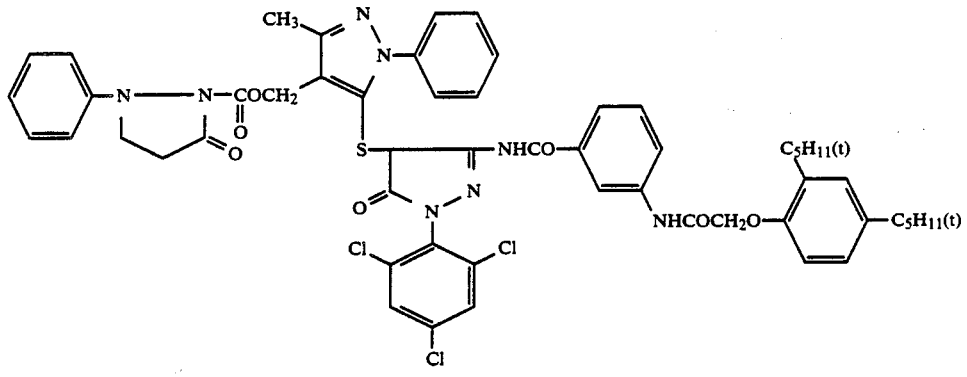
14.
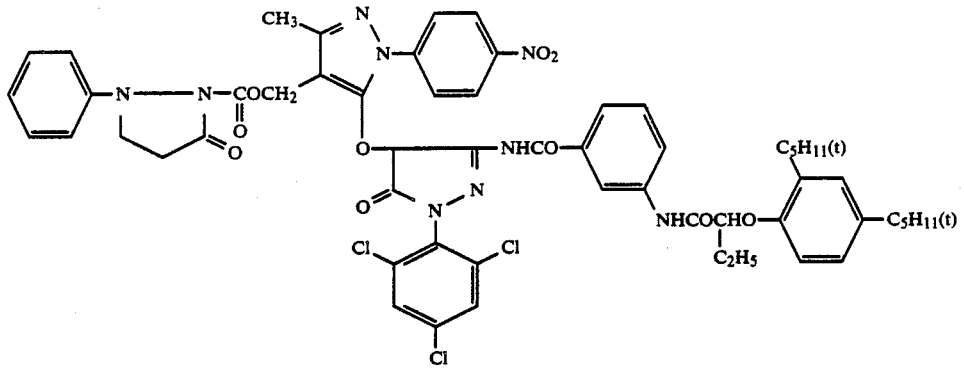
15.
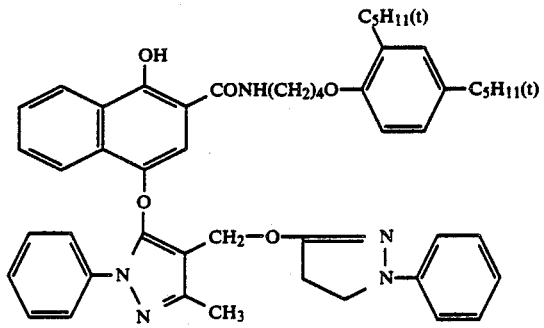

-continued
16.
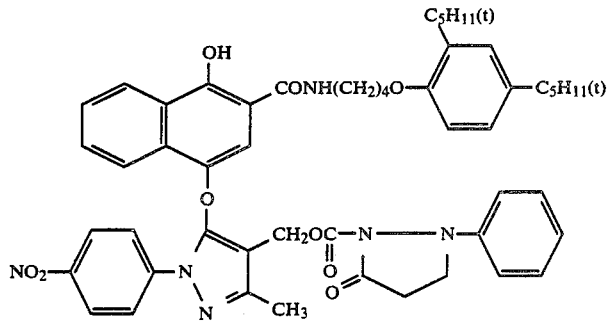
17.
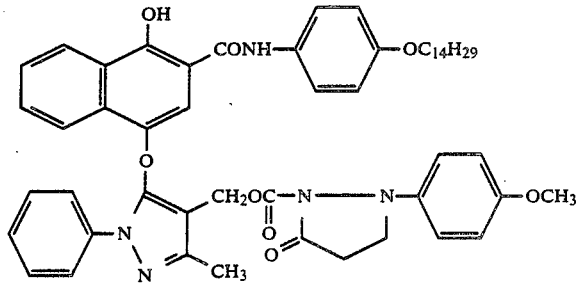
18.
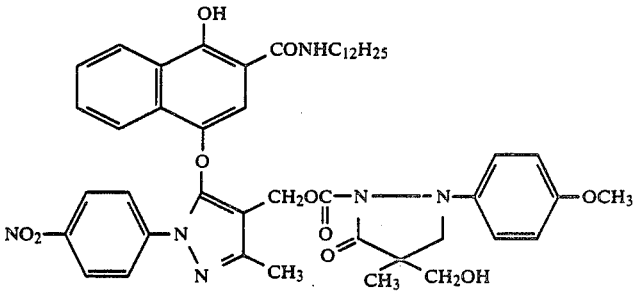
19.
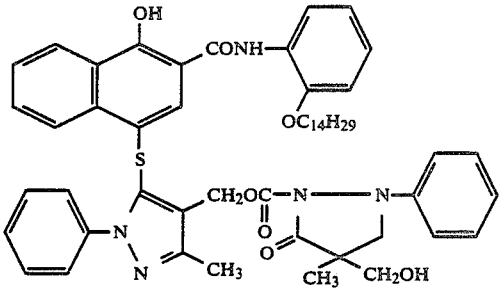
20.
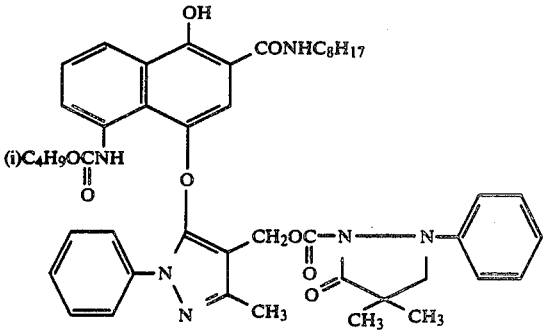

-continued

21.

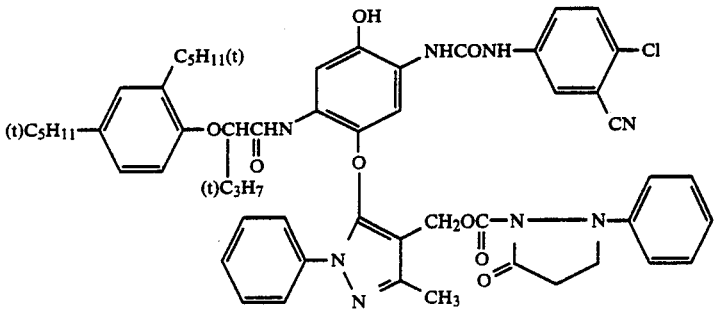

22.

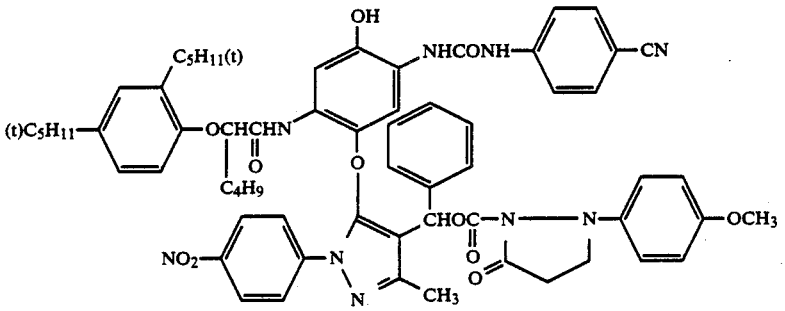

23.

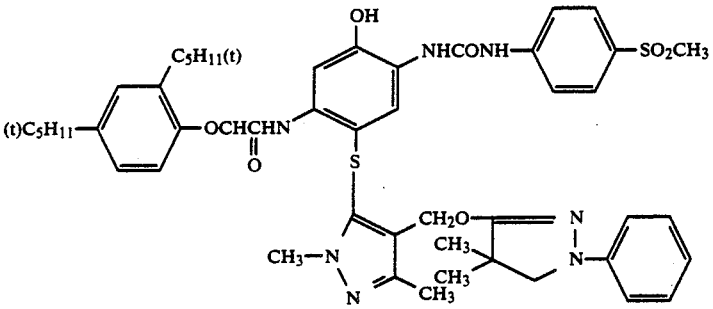

Next, representative synthesis example of the compounds according to the present invention is shown.

SYNTHESIS EXAMPLE (synthesis of Exemplary compound 17)

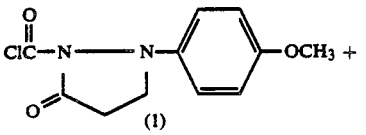

(1)

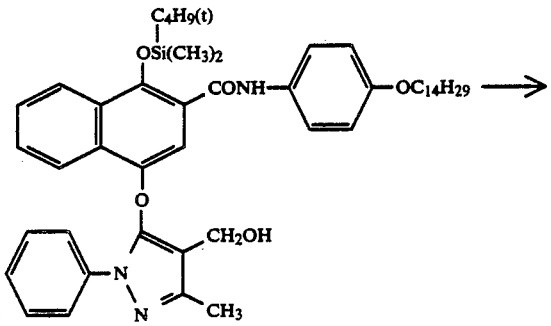

(2)

-continued

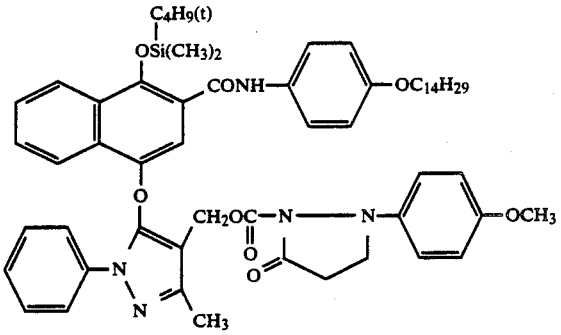

(3)

In 50 ml of nitrile and 5 ml of methylene chloride was dissolved 7.0 g of (2), and under nitrogen atmosphere, 1.0 g of 2,6-ruthidine was added at once at room temperature while dissipating, and further 2.3 g of (1) was added over 30 minutes and the mixture was stirred for one hour. To the reaction mixture was added ethyl acetate, and the mixture was neutralized by washing with water. Then, ethyl acetate was removed under reduced pressure and the residue was purified by column chromatography to obtain 5 g of (3).

Subsequently, the product was dissolved in 100 ml of THF and under nitrogen atmosphere, 20 ml of a 5 % trifluoroacetic acid solution was added and the mixture was stirred at room temperature for 10 hours. To the reaction mixture was added ethyl acetate, and the mixture was neutralized by washing with water. Then, ethyl acetate was removed under reduced pressure and the residue was purified by column chromatography to obtain 3.8 g of white crystals. Identification of the product was carried out by NMR and MS spectrum to confirm that the product is Exemplary compound 17.

As for the other compounds of the present invention, synthesis can be done by the same synthetic method.

The compound of the present invention may be added in a silver halide emulsion layer in combination with a coupler which forms a dye image, as the same as said coupler or as an independent compound, or may be added as an emulsified material in a non-light-sensitive layer. The compound of the present invention may be used singly or in combination of two or more kinds.

An amount of the compound according to the present invention is preferably 0.1 to 100 mole %, particularly preferably 0.1 to 50 mole % per one mole of the coupler.

A dye image-forming coupler to be combinedly used with the compound according to the present invention may be di-equivalent or tetra-equivalent, and as a yellow coupler, there may be mentioned a closed-chain ketomethylene compound such as a pivalylacetanilide type and benzoylacetanilide type yellow coupler, as a magenta coupler, there may be mentioned a pyrazolone type, a pyrazolotriazole type, a pyrazolinobenzimidazole type and an indazolone type compounds, and as a cyan coupler, there may be mentioned a phenol type and a naphthol type compounds, respectively. Also, a coupler for masking, a competing coupler, a DIR coupler and a bleaching accelerator releasing coupler may be used in combination with the compound of the present invention.

For adding the compound according to the present invention and a hydrophobic compound including the above various couplers to a light-sensitive material, for example, an oil droplet-in-water dispersing method may be used.

For example, hydrophobic compounds are dissolved with a high boiling point solvent such as tricresyl phosphate and dibutyl phthalate or a low boiling point solvent such as butyl acetate and butyl propionate, each singly or if necessary, in combination thereof (mixture), and then mixing with a gelatin aqueous solution containing a surfactant, emulsifying by a high speed rotary mixer or a colloid mill, and then adding to silver halide to prepare a silver halide emulsion.

In an emulsion layer or non-light-sensitive layer containing the compound according to the present invention, a reducing agent or an antioxidant such as sulfites (sodium sulfite and potassium sulfite), bisulfites (sodium bisulfite and potassium bisulfite), hydroxylamines (hydroxylamine, N-methylhydroxylamine and N-phenylhydroxylamine), sulfinic acids (sodium phenylsulfinate), hydrazines (N,N-dimethylhydrazine), reductones (ascorbic acid), aromatic hydrocarbons having at least one hydroxyl group (p-aminophenol, alkylhydroquinone, gallic acid, catechol, resorcin and 2,3-dihydroxynaphthalene) may be used combinedly.

Further, in order to improve light fastness of a magenta dye image formed by a magenta coupler to be used in the present invention, p-alkoxyphenols or phenolic compounds may be added to said emulsion layer or an adjacent layer thereto.

As for layer constitution of the light-sensitive silver halide photographic material of the present invention, usual subtractive color system may be employed. Basically, the basic constitution is a three layers constitution in which a yellow coupler for forming a yellow dye is added to a blue-sensitive light-sensitive layer, a magenta coupler for forming a magenta dye is added to a green-sensitive light-sensitive layer and a cyan coupler for forming a cyan dye is added in a red-sensitive light-sensitive material, respectively. Further, when either of respective layers or whole layers are made multiple layer such as double or triple layers in which sensitivities are different from each other but color sensitivities are the same, or an intermediate layer is provided between respective layer of double or triple layers, various photographic characteristics such as coloring characteristics, color reproducibility and coloring dye graininess can be improved.

In addition to these basic emulsion layers, by providing respective layers such as a protective layer at the uppermost layer, an intermediate layer and a filter layer between layers, and a subbing layer and an anti-halation layer at the lowermost layer, appropriately, protection, prevention of color stain, improvement in graininess, improvement in color reproduction and improvement in film attachment can be further attained.

As the silver halide to be used in the light-sensitive silver halide photographic material, optional silver halide to be used in usual light-sensitive silver halide photographic material such as silver chloride, silver bromide, silver iodide, silver chlorobromide, silver iodobromide and silver chloroiodobromide may be included.

The above silver halide emulsions can be sensitized by well known chemical sensitizers. As the chemical sensitizers, a noble metal sensitizer, a sulfur sensitizer, a selenium sensitizer and a reduction sensitizer may be used singly or in combination.

As a binder for silver halide, a binder well known in the art can be used. Further, the silver halide emulsion of the present invention can be spectrally sensitized by using a sensitizing dye well known in the art, if necessary.

To the aforesaid silver halide emulsion, in order to prevent sensitivity deterioration during the preparation, preservation or processing of the light-sensitive material or generation of fog, various compound such as heterocyclic compounds including 1-phenyl-5-mercaptotetrazole, 3-methylbenzothiazole and 4-hydroy-6-methyl-1,3,3a,7-tetrazaindene, mercapto compounds and metal salts may be added.

Also, film hardening treatment of the above emulsion can be carried out according to the conventional method.

To the above silver halide emulsion, a surfactant(s) may be added singly or in combination. As the surfactants, there may be used coating aids, emulsifiers, improvers in permeability to processing solutions, defoaming agents, antistatic agents, adhesion resistant agents, and various activators for improvement in photographic characteristics or controlling physical properties.

The light-sensitive silver halide photographic material thus constituted is, after imagewise exposure, applied to photographic processing including a step of color developing processing in the presence of a color developing agent.

In the present invention, photographic processing includes respective processing steps which are applied after imagewise exposure of the usual subtractive color system light-sensitive silver halide color photographic material, and it basically includes color developing processing step, and bleaching processing step and fixing processing step, or bleach-fixing processing step, as main processing steps, and if necessary, black-and-white developing processing step, washing step and stabilizing processing step. At least one of the processing solutions (for example, color developing solution, bleaching solution, fixing solution or bleach-fixing solution) to be used in these processing steps is made alkaline and processing is carried out under the alkaline circumstance.

The color developing agent to be used in the photographic processing according to the present invention is an alkaline aqueous solution containing a developing agent and having a pH of 8 or more, preferably a pH of 9 to 12. An aromatic primary amine developing agent as the developing agent means a compound having a primary amine group on the aromatic ring and having an ability of developing silver halide exposed, or a precursor capable of forming such a compound. As the above developing agent, p-phenylene diamine series one is a representative one and the following are mentioned as preferred examples.

4-Amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethyl-4-amino-N,N-diethylaniline, 3-methoxy-4-amino-N,N-diethylaniline, 3-methoxy-4-amino-N-ethyl-N-β-hydroxyethylaniline, 3-methoxy-4-amino-N-ethyl-N-β-methoxyethylaniline, 3-acetamido-4-amino-N,N-diethylaniline, 4-amino-N,N-dimethylaniline, N-ethyl-N-β-[β-(β-methoxyethoxy)ethoxy]ethyl-3-methyl-4-aminoaniline, N-ethyl-N-β-(β-methoxyethoxy)ethyl-3-methyl-4-aminoaniline, or a salt thereof such as sulfate, hydrochloride, sulfite and p-toluenesulfonate. Also, to these color developing solution, various additives may be added, if necessary.

To the light-sensitive silver halide photographic material according to the present invention, after color developing processing step, optional combination of processing steps such as bleaching processing step, fixing processing step, or bleach-fixing processing step, washing step and stabilizing processing step may be carried out as photographic processing according to the present invention in accordance with the conventional manner.

EXAMPLES

In the following, the present invention is explained by referring to Examples, but the present invention is not limited by these Examples.

In the following all Examples, added amounts in the light-sensitive silver halide photographic material are shown by gram(s) per 1 $m^2$ otherwise specifically mentioned. Also, silver halide and colloidal silver are shown calculated on silver. Sensitizing dyes are shown by molar number per one mole of silver.

EXAMPLE 1

On a triacetylcellulose film support were formed respective layers having compositions shown below from the support side successively to prepare Sample 1 of a multi-layer light-sensitive color photographic material.

Sample - 1 (Comparative)

| | |
|---|---|
| First layer; Anti-halation layer (HC) | |
| Black colloidal silver | 0.15 |
| UV absorber (UV - 1) | 0.20 |
| Colored coupler (CC - 1) | 0.02 |
| High boiling point solvent (Oil - 1) | 0.20 |
| High boiling point solvent (Oil - 2) | 0.20 |
| Gelatin | 1.6 |
| Second layer; Intermediate layer (I.L. - 1) | |
| Gelatin | 1.3 |
| Third layer; Low sensitivity red-sensitive silver halide emulsion layer (RL) | |
| Silver iodobromide emulsion (Em - 1) | 0.4 |
| Silver iodobromide emulsion (Em - 2) | 0.3 |
| Sensitizing dye (S - 1) | $3.2 \times 10^{-4}$ (mole/mole Ag) |
| Sensitizing dye (S - 2) | $3.2 \times 10^{-4}$ (mole/mole Ag) |
| Sensitizing dye (S - 3) | $0.2 \times 10^{-4}$ (mole/mole Ag) |
| Cyan coupler (C - 1) | 0.5 |
| Cyan coupler (C - 2) | 0.13 |
| Colored cyan coupler (CC - 1) | 0.07 |
| DIR compound (D - 1) | 0.006 |
| DIR compound (D - 2) | 0.01 |
| High boiling point solvent (Oil - 1) | 0.55 |
| Additive (SC - 1) | 0.003 |
| Gelatin | 1.0 |
| Comparative compound 1 | 0.126 |
| Fourth layer; High sensitivity red-sensitive silver halide emulsion layer (RH) | |
| Silver iodobromide emulsion (Em - 3) | 0.9 |
| Sensitizing dye (S - 1) | $1.7 \times 10^{-4}$ (mole/mole Ag) |
| Sensitizing dye (S - 2) | $1.6 \times 10^{-4}$ (mole/mole Ag) |
| Sensitizing dye (S - 3) | $0.1 \times 10^{-4}$ (mole/mole Ag) |
| Cyan coupler (C - 2) | 0.23 |
| Colored cyan coupler (CC - 1) | 0.03 |
| DIR compound (D - 2) | 0.02 |
| High boiling point solvent (Oil - 1) | 0.25 |
| Additive (SC - 1) | 0.003 |
| Gelatin | 1.0 |
| Comparative compound 1 | 0.046 |
| Fifth layer; Intermediate layer (I.L. - 2) | |
| Gelatin | 0.8 |
| Sixth layer; Low sensitivity green-sensitive silver halide emulsion layer (GL) | |
| Silver iodobromide emulsion (Em - 1) | 0.6 |
| Silver iodobromide emulsion (Em - 2) | 0.2 |
| Sensitizing dye (S - 4) | $6.7 \times 10^{-4}$ (mole/mole Ag) |
| Sensitizing dye (S - 5) | $0.8 \times 10^{-4}$ (mole/mole Ag) |
| Magenta coupler (M - 1) | 0.17 |
| Magenta coupler (M - 2) | 0.43 |
| Colored magenta coupler (CM - 1) | 0.10 |
| DIR compound (D - 3) | 0.02 |
| High boiling point solvent (Oil - 2) | 0.70 |
| Additive (SC - 1) | 0.003 |
| Gelatin | 1.0 |
| Seventh layer; High sensitivity green-sensitive silver halide emulsion layer (GH) | |
| Silver iodobromide emulsion (Em - 3) | 0.9 |
| Sensitizing dye (S - 6) | $1.1 \times 10^{-4}$ (mole/mole Ag) |
| Sensitizing dye (S - 7) | $2.0 \times 10^{-4}$ (mole/mole Ag) |
| Sensitizing dye (S - 8) | $0.3 \times 10^{-4}$ (mole/mole Ag) |
| Magenta coupler (M - 1) | 0.03 |
| Magenta coupler (M - 2) | 0.13 |
| Colored magenta coupler (CM - 1) | 0.04 |
| DIR compound (D - 3) | 0.04 |
| High boiling point solvent (Oil - 2) | 0.35 |
| Additive (SC - 1) | 0.003 |
| Gelatin | 1.0 |
| Eighth layer; Yellow filter layer (YC) | |
| Yellow colloidal silver | 0.1 |
| Additive (HS - 1) | 0.07 |
| Additive (HS - 2) | 0.07 |
| Additive (SC - 2) | 0.12 |
| High boiling point solvent (Oil - 2) | 0.15 |
| Gelatin | 1.0 |
| Ninth layer; Low sensitivity blue-sensitive silver halide emulsion layer (BL) | |
| Silver iodobromide emulsion (Em - 1) | 0.25 |
| Silver iodobromide emulsion (Em - 2) | 0.25 |
| Sensitizing dye (S - 9) | $5.8 \times 10^{-4}$ (mole/mole Ag) |

-continued

| | |
|---|---|
| Yellow coupler (Y - 1) | 0.60 |
| Yellow coupler (Y - 2) | 0.32 |
| DIR compound (D - 1) | 0.003 |
| DIR compound (D - 2) | 0.006 |
| High boiling point solvent (Oil - 2) | 0.18 |
| Additive (SC - 1) | 0.004 |
| Gelatin | 1.3 |
| Tenth layer; High sensitivity blue-sensitive silver halide emulsion layer (BH) | |
| Silver iodobromide emulsion (Em - 4) | 0.5 |
| Sensitizing dye (S - 10) | $3.0 \times 10^{-4}$ (mole/mole Ag) |
| Sensitizing dye (S - 11) | $1.2 \times 10^{-4}$ (mole/mole Ag) |
| Yellow coupler (Y - 1) | 0.18 |
| Yellow coupler (Y - 2) | 0.10 |
| High boiling point solvent (Oil - 2) | 0.05 |
| Additive (SC - 1) | 0.002 |
| Gelatin | 1.0 |
| Eleventh layer; First protective layer (Pro - 1) | |
| Silver iodobromide emulsion (Em - 5) | 0.3 |
| UV absorber (UV - 1) | 0.07 |
| UV absorber (UV - 2) | 0.1 |
| Additive (HS - 1) | 0.2 |
| Additive (HS - 2) | 0.1 |
| High boiling point solvent (Oil - 1) | 0.07 |
| High boiling point solvent (Oil - 3) | 0.07 |
| Gelatin | 0.8 |
| Twelfth layer; Second protective layer (Pro - 2) | |
| Alkali soluble matting agent (average particle size: 2 μm) | 0.13 |

-continued

| | |
|---|---|
| Polymethyl methacrylate particle (average particle size: 3 μm) | 0.02 |
| Anti-slip agent (WAX - 1) | 0.04 |
| Antistatic agent (SU - 1) | 0.004 |
| Antistatic agent (SU - 2) | 0.02 |
| Gelatin | 0.5 |

To the above respective layers, in addition to the above compositions, a coating aid SU-4, a dispersing aid SU-3, a hardener H-1 and/or H-2, a stabilizer ST-1, an antispetic agent DI-1, an antifoggant AF-1 and/or AF-2, and a dye AI-1 and/or AI-2 are optionally added.

Also, the emulsions used in the above sample are as shown below.

Either of them is a monodispersed emulsion of an inner portion-high iodide content type.

Em-1: Average silver iodide content 7.5 mole, octahedral, average particle size 0.55 μm.

Em-2: Average silver iodide content 2.5 mole, octahedral, average particle size 0.36 μm.

Em-3: Average silver iodide content 8.0 mole, octahedral, average particle size 0.84 μm.

Em-4: Average silver iodide content 8.5 mole, octahedral, average particle size 1.02 μm.

Em-5: Average silver iodide content 2.0 mole, octahedral, average particle size 0.08 μm.

S-1

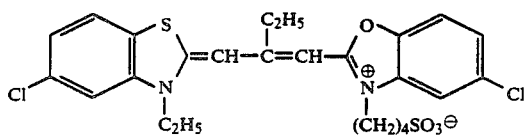

S-2

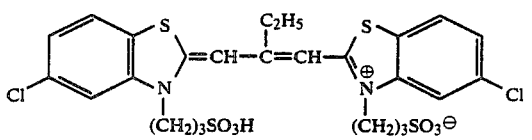

S-3

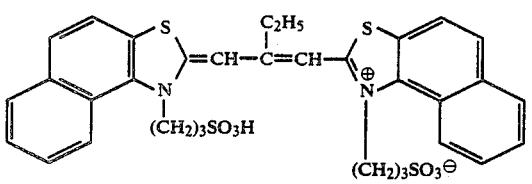

S-4

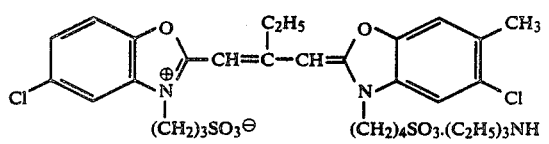

S-5

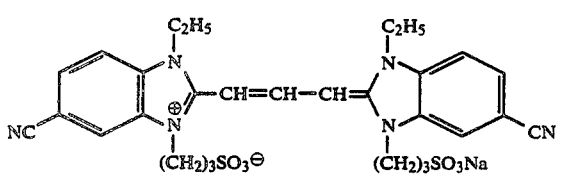

S-6

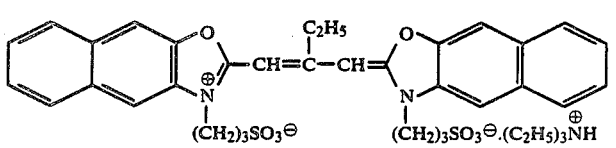

-continued
S-7
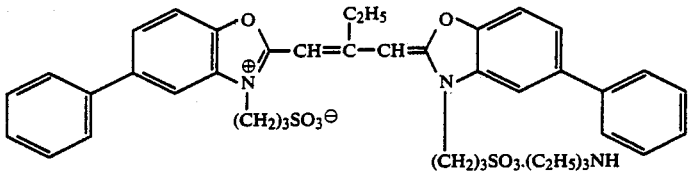
S-8
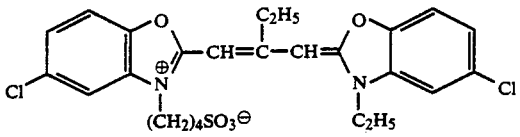
S-9
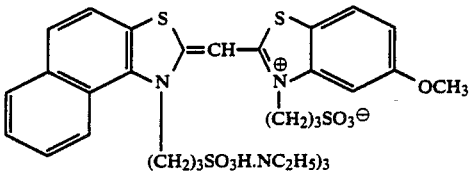
S-10
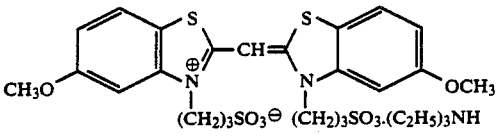
S-11
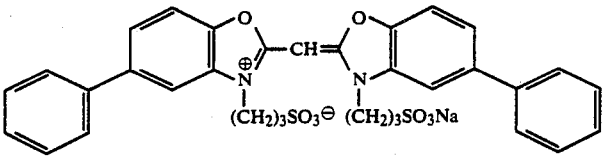
C-1
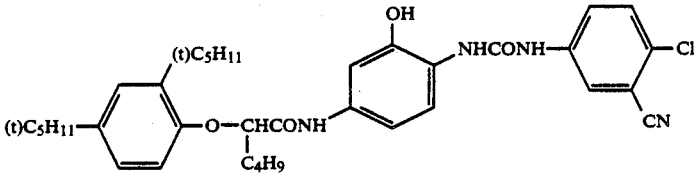
C-2
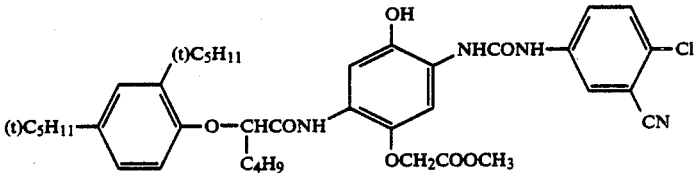
M-1
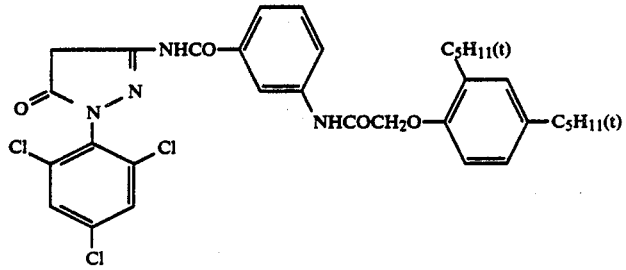

-continued
M-2
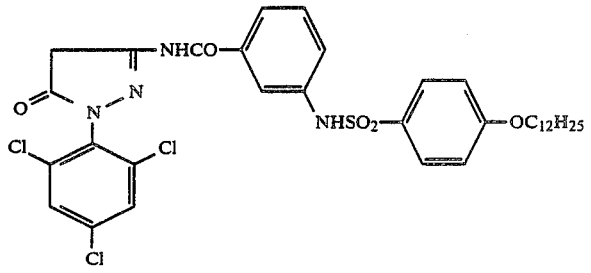
Y-1
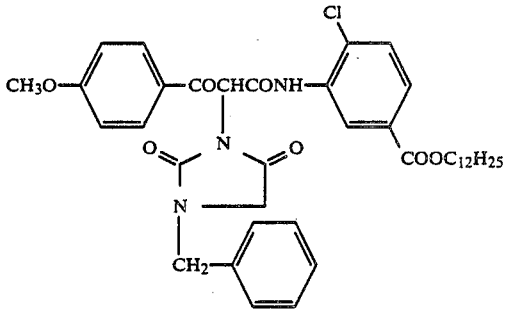
Y-2
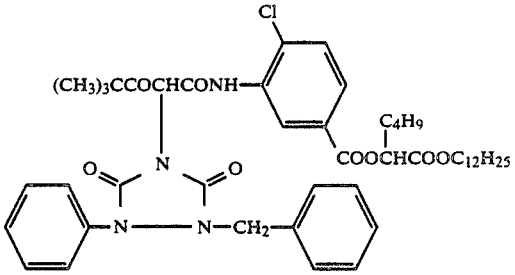
CO-1
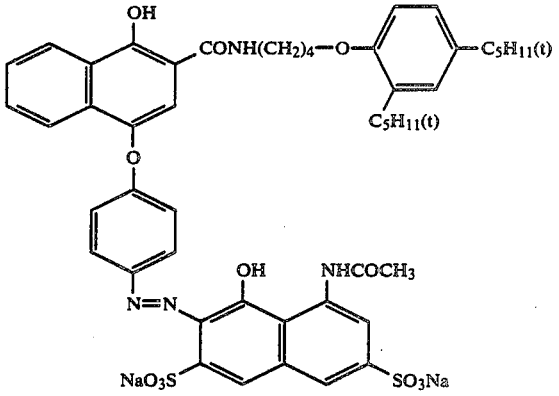

-continued
CM-1
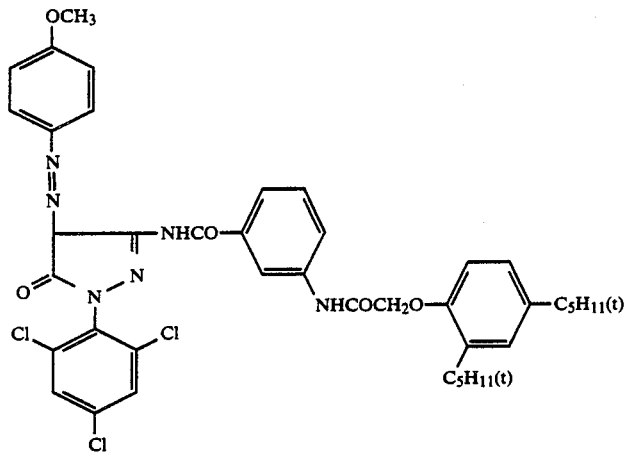
D-1
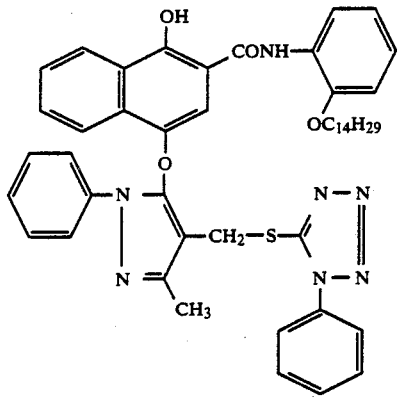
D-2
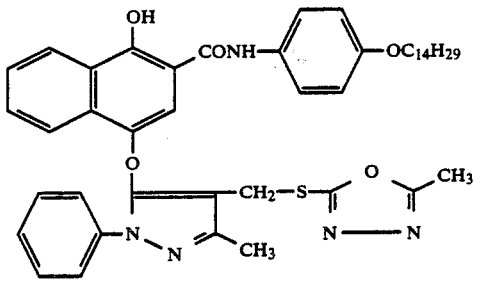
D-3
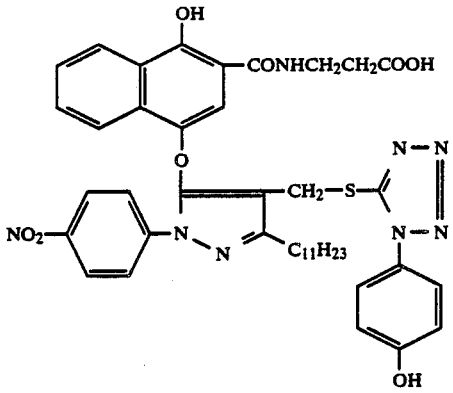

-continued
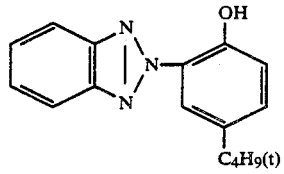
UV-1
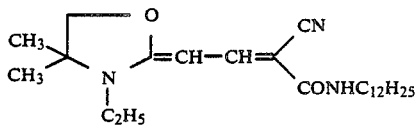
UV-2
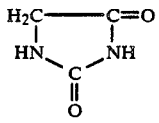
HS-1
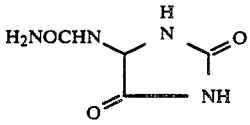
HS-2
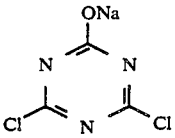
H-1
$[(CH_2{=}CHSO_2CH_2)_3CCH_2SO_2(CH_2)_2]_2N(CH_2)_2SO_3K$ H-2
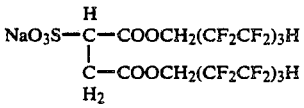
Su-1
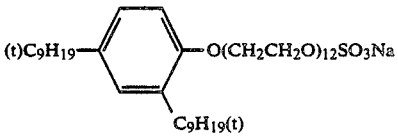
Su-2
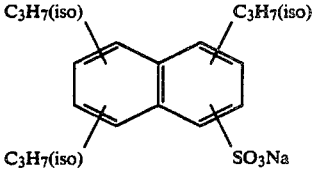
Su-3
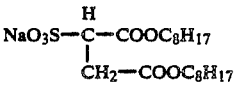
Su-4
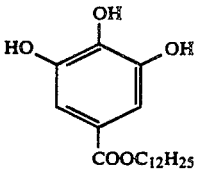
Sc-1

-continued
Sc-2
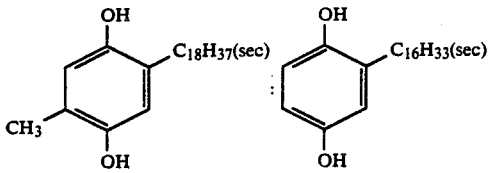
mixture (2:3)
Oil-1
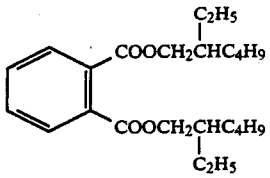
Oil-2
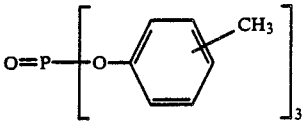
Oil-3
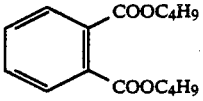
AI-1
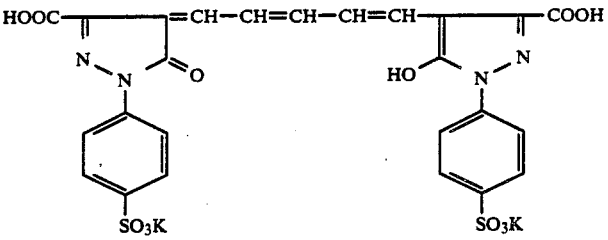
AI-2
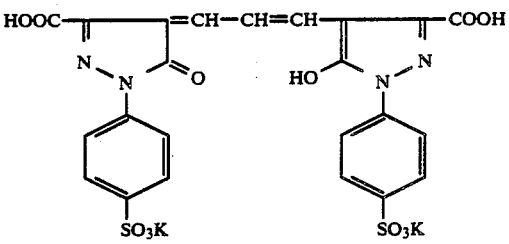
WAX-1
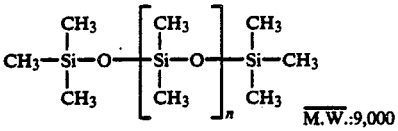
ST-1
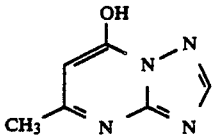

-continued

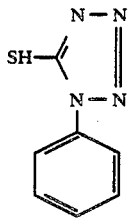

AF-1

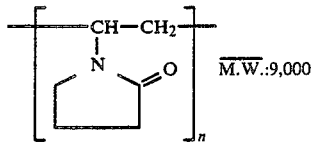

AF-2

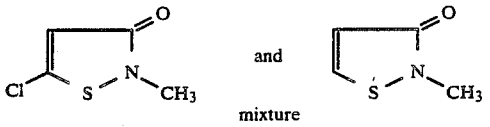

DI-1

COMPARATIVE COMPOUND 1 (compound disclosed in Japanese Provisional Patent Publication No. 113060/1986)

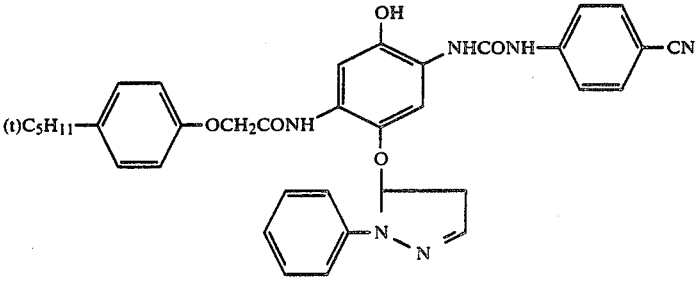

COMPARATIVE COMPOUND 2 (compound disclosed in U.S. Pat. No. 4,859,578)

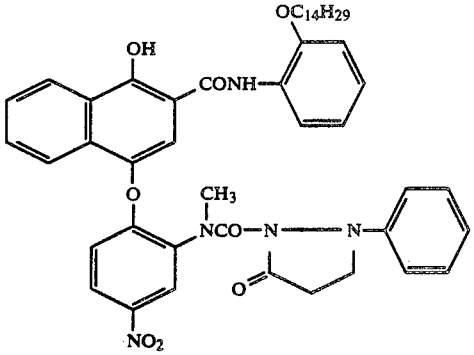

Each sample was prepared in the same manner as in Sample 1 except for using a compound shown in Table 1 instead of the comparative compound 1 in Sample 1 with an equal molar amount.

These respective samples were subjected to red color wedge exposure using an intensity scale sensitometer, followed by color developing processing according to the following processing steps.

| Processing steps (38° C.) | |
|---|---|
| Color development | 3 min 15 sec |
| Bleaching | 6 min 30 sec |
| Washing | 3 min 15 sec |
| Fixing | 6 min 30 sec |
| Washing | 3 min 15 sec |
| Stabilizing | 1 min 30 sec |

Compositions of processing solutions used in each processing step are as shown below.

| | |
|---|---|
| (Composition of color developing solution) | |
| 4-Amino-3-methyl-N-ethyl-N-(β-hydroxyethyl)-aniline.sulfate | 4.75 g |
| Anhydrous sodium sulfite | 4.25 g |
| Hydroxylamine.½sulfate | 2.0 g |
| Anhydrous potassium carbonate | 37.5 g |
| Sodium bromide | 1.3 g |
| Nitrilotriacetic acid.trisodium salt (monohydrate) | 2.5 g |
| Potassium hydroxide | 1.0 g |
| Made up to one liter with addition of water, and adjusted to pH 10.0 by using potassium hydroxide. | |
| (Composition of bleaching solution) | |
| Iron ethylenediaminetetraacetate ammonium salt | 100.0 g |
| Ethylenediaminetetraacetate di-ammonium salt | 10.0 g |
| Ammonium bromide | 150.0 g |
| Glacial acetic acid | 10.0 ml |
| Made up to one liter with addition of water, and adjusted to pH 6.0 by using aqueous ammonia. | |
| (Composition of fixing solution) | |

-continued

| | |
|---|---|
| Ammonium thiosulfate | 175.0 g |
| Anhydrous sodium sulfite | 8.5 g |
| Sodium metasulfite | 2.3 g |
| Made up to one liter with addition of water, and adjusted to pH 6.0 by using acetic acid. | |

TABLE 1

| Sample No. | | Compound | Sensitivity | Fog | Gamma | Maximum coloring density | RMS |
|---|---|---|---|---|---|---|---|
| 1 | Comparative | Comparative compound 1 | 100 | 0.28 | 0.68 | 2.20 | 33.1 |
| 2 | Comparative | Comparative compound 2 | 102 | 0.28 | 0.69 | 2.25 | 31.1 |
| 3 | This invention | Compound 15 | 108 | 0.25 | 0.73 | 2.42 | 27.0 |
| 4 | This invention | Compound 16 | 111 | 0.25 | 0.75 | 2.42 | 25.7 |
| 5 | This invention | Compound 17 | 112 | 0.25 | 0.76 | 2.42 | 26.0 |
| 6 | This invention | Compound 21 | 110 | 0.26 | 0.74 | 2.42 | 26.9 |
| 7 | This invention | Compound 23 | 107 | 0.26 | 0.72 | 2.42 | 27.0 |

As can be seen from Table 1, it can be understood that Samples using compounds of the present invention show low fog, high in color density, gamma and sensitivity, and yet graininess is remarkably improved as compared with that containing the comparative compound.

Also, samples wherein comparative compound 1 in Sample 1 was excluded and the compounds 1, 2, 4, 7 and 8 according to the present invention were added in the ninth layer and the tenth layer with amounts of 20 mole % based on that of the yellow coupler were each subjected to blue light wedge exposure and the same processing steps were carried out. When the resulting samples were measured in the same manner as mentioned above, the same effects of the present invention as mentioned above can be obtained.

The light-sensitive silver halide color photographic material containing specific coupler according to the present invention accomplishes effects of high sensitivity, high gamma and high coloring density, and yet excellent in graininess and not increasing in fog.

We claim:

1. In a light-sensitive silver halide color photographic material containing color couplers in at least one silver halide emulsion layer provided on a support, the improvement wherein a compound represented by the formula (Q):

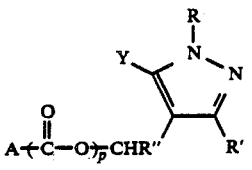

(Q)

wherein R represents a hydrogen atom, an alkyl group, an alkoxy group, an aryl group, an acyl group, a sulfonyl group, an alkoxycarbonyl group or a heterocyclic group; R′ represents a hydrogen atom, an alkyl group, an aryl group, an alkoxy group, an amino group, an amide group, a sulfonamide group, a carboxyl group, an alkoxycarbonyl group, a carbamoyl group or a cyano group; R″ represents a hydrogen atom, an alkyl group or an aryl group; A represents a residue of 1-phenyl-3-pyrazolidones; Y represents a residue of a non-diffusion type coupler bonded at the decoupling off position through an oxygen atom, a sulfur atom or an imino group which is unsubstituted or substituted with an alkyl group, an aryl group, an acyl group or a sulfonyl group; and p is 0 to 1;

is contained in the photographic emulsion layer in an amount of 0.1 to 50 mole % based on the amount of color coupler in the emulsion layer.

2. The light-sensitive silver halide photographic material according to claim 1, wherein the imino group is used for bonding and is substituted by the aryl group, the acyl group or the sulfonyl group.

3. The light-sensitive silver halide photographic material according to claim 1, wherein R″ represents an alkyl group.

4. The light-sensitive silver halide photographic material according to claim 1, wherein R″ represents an aryl group.

5. The light-sensitive silver halide photographic material according to claim 1, wherein the unsubstituted imino group is used for bonding.

6. The light-sensitive silver halide photographic material according to claim 1, wherein the residue of the non-diffusion type coupler is selected from the group consisting of a residue of the non-diffusive type coupler which forms a yellow, magenta or cyan dye and a residue of the non-diffusive type coupler which forms a substantially colorless product.

7. The light-sensitive silver halide photographic material according to claim 6, wherein said 1-phenyl-3-pyrazolidone derivatives is represented by the formula (P-1) or (P-2):

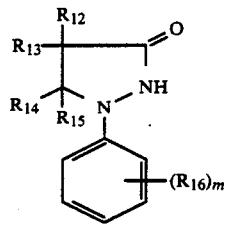

(P-1)

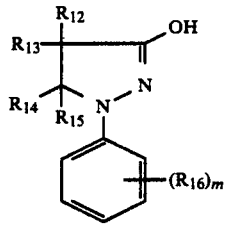

(P-2)

wherein $R_{12}$ to $R_{15}$ each represent a hydrogen atom, an alkyl group or an aryl group; $R_{16}$ represents a halogen atom, an alkyl group or an alkoxy group; m is an integer of 0 to 4, and when m is 2 or more, $R_{16}$'s may be the same or different.

8. The light-sensitive silver halide photographic material according to claim 7, wherein a residue of 1-phenyl-3-pyrazolidone derivatives represented by A is a group in which a hydrogen at 2-position of a pyrazolidine ring in the formula (P-1) is removed or a group in which a hydrogen atom of a hydroxy group which is a substituent at 3-position of 2-pyrazoline ring in the formula (P-2) is removed.

9. The light-sensitive silver halide photographic material according to claim 6, wherein said yellow coupler residue is used and is represented by the formula (I) or (II):

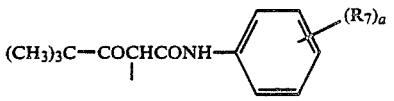
(I)

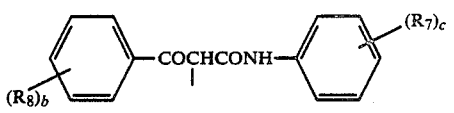
(II)

wherein $R_7$ and $R_8$ each represent an alkyl group, a cycloalkyl group, an aryl group and a heterocyclic group, or a halogen atom, said alkyl group, cycloalkyl group, aryl group and heterocyclic group may be bonded though an oxygen atom, a nitrogen atom or a sulfur atom; a represents an integer of 1 to 5; b and c each represent an integer of 0 to 5, and when each a, b and c is 2 or more, $R_7$'s or $R_8$'s may be the same or different from each other.

10. The light-sensitive silver halide photographic material according to claim 6, wherein said magenta coupler residue is used and is represented by the formula (III), (IV), (V) or (VI):

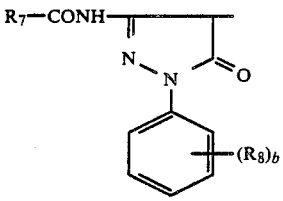
(III)

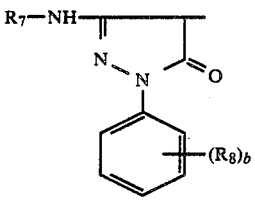
(IV)

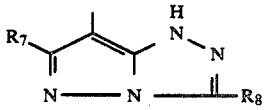
(V)

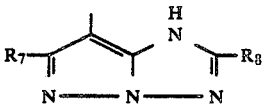
(VI)

wherein $R_7$ and $R_8$ each represent an alkyl group, a cycloalkyl group, an aryl group and a heterocyclic group, or a halogen atom, said alkyl group, cycloalkyl group, aryl group and heterocyclic group may be bonded through an oxygen atom, a nitrogen atom or a sulfur atom; b represents an integer of 0 to 5, and when b is 2 or more, $R_8$'s may be the same or different from each other.

11. The light-sensitive silver halide photographic material according to claim 6, wherein said cyan coupler residue is used and is represented by the formula (VII), (VIII) or (IX):

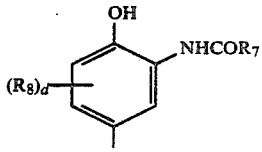
(VII)

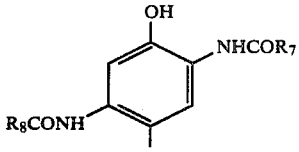
(VIII)

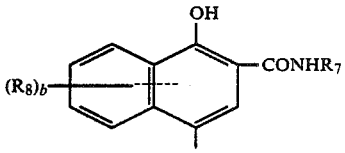
(IX)

wherein $R_7$ and $R_8$ each represent an alkyl group, a cycloalkyl group, an aryl group and a heterocyclic group, or a halogen atom, said alkyl group, cycloalkyl group, aryl group and heterocyclic group may be bonded through an oxygen atom, a nitrogen atom or a sulfur atom; b represents an integer of 0 to 5; d represents an integer of 0 to 3, and when each b and d is 2 or more, $R_8$'s may be the same or different from each other.

12. The light-sensitive silver halide photographic material according to claim 6, wherein said coupler residue forming a substantially colorless product is used and is represented by the formula (X), (XI), (XII) or (XIII):

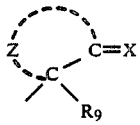
(X)

wherein $R_9$ represents a hydrogen atom, an alkyl group an aryl group, a halogen atom, an alkoxy group, an acyloxy group or a heterocyclic group; X represents an oxygen atom or $=N-R_{10}$, where $R_{10}$ represents an alkyl group, an aryl group, a hydroxy group, an alkoxy group or a sulfonyl group; Z represents a non-metallic atom group necessary for forming a 5- to 7-membered carbon ring,

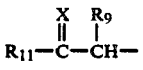
(XI)

wherein $R_9$ and Z have the same meanings as $R_9$ and X in the formula (X), respectively; and $R_{11}$ represents an alkyl group, an aryl group, a heterocyclic group, a cyano group, a hydroxy group, an alkoxy group, an aryloxy group, a heterocyclicoxy group, an alkylamino group, a dialkylamino group or an anilino group,

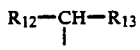

(XII)

wherein $R_{12}$ and $R_{13}$ each represent an alkoxycarbonyl group, a carbamoyl group, an acyl group, a cyano group, a formyl group, a sulfonyl group, a sulfinyl group, a sulfamoyl group, an ammonium group or

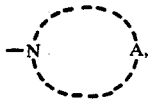

where A represents a non-metallic atom group necessary for forming a 5- to 7-membered heterocyclic ring with a nitrogen atom, and

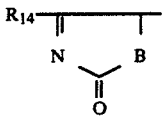

(XIII)

wherein $R_{14}$ represents an alkyl group, an aryl group, an anilino group, an alkylamino group or an alkoxy group; and B represents an oxygen atom, a sulfur atom or a nitrogen atom.

13. In a light-sensitive silver halide color photographic material containing color couplers in at least one silver halide emulsion layer provided on a support, the improvement comprising a content of 0.1 to 50 mole % based on the amount of coupler in the emulsion layer, of a compound selected from the following compounds:

1.

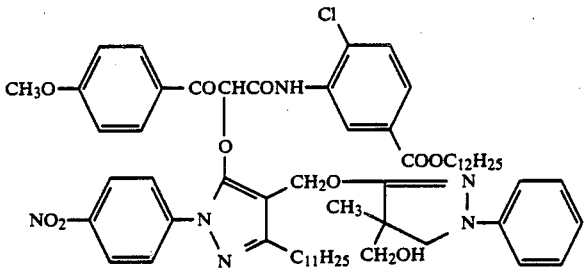

2.

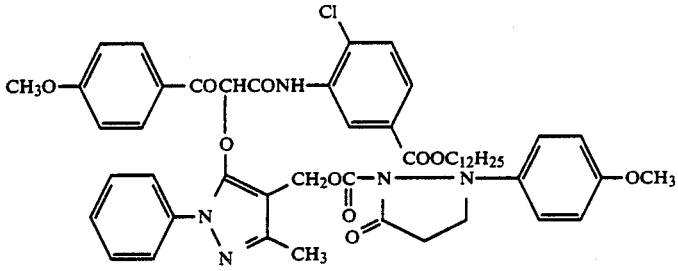

3.

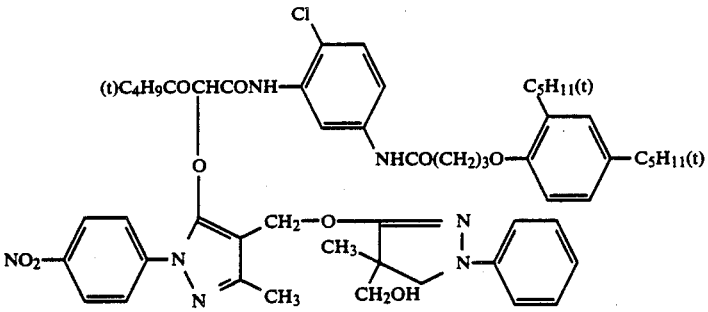

4.

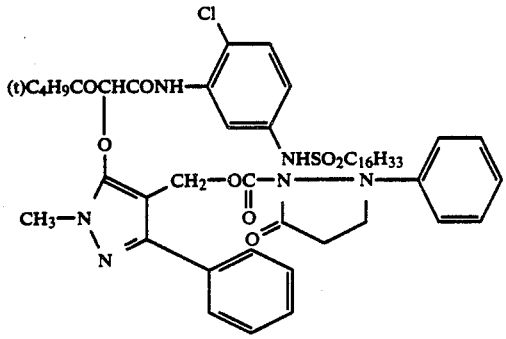

-continued
5.
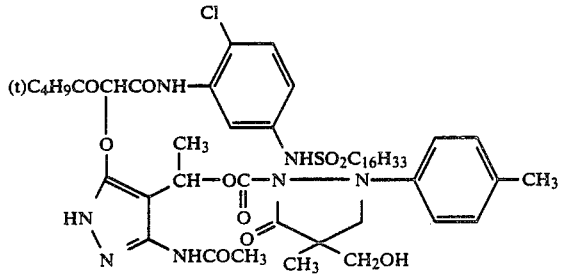
6.
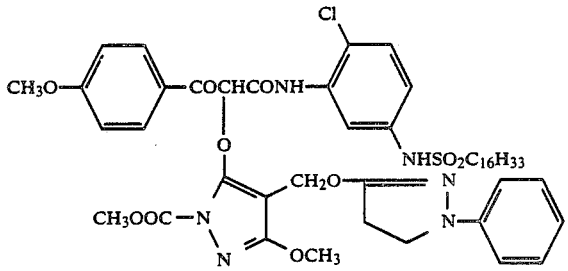
7.
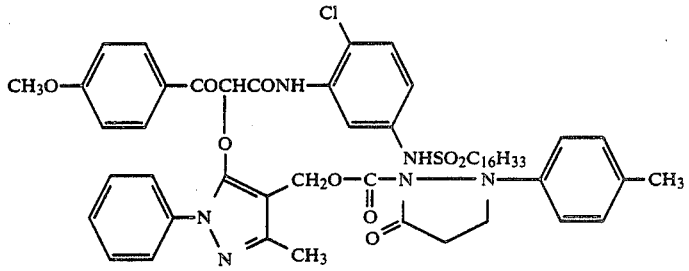
8.
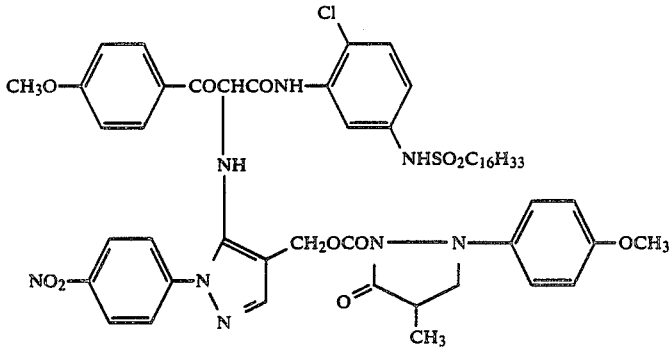
9.
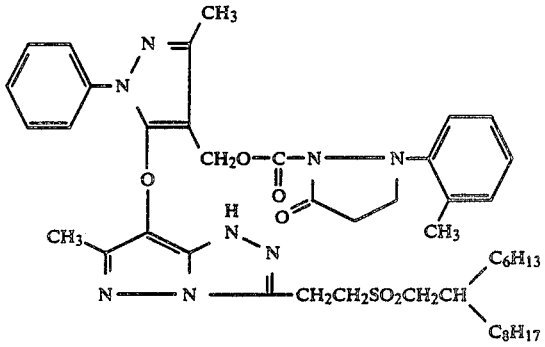

-continued
10.
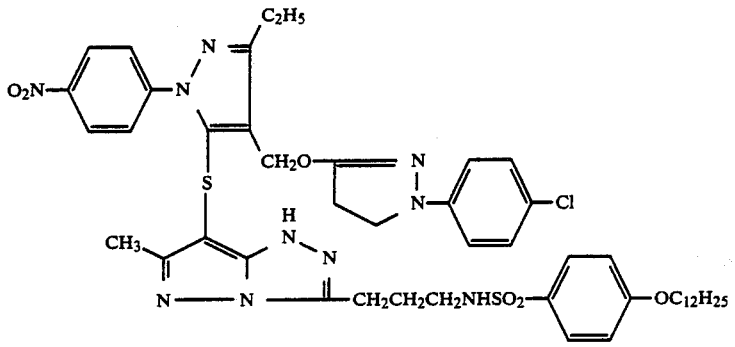
11.
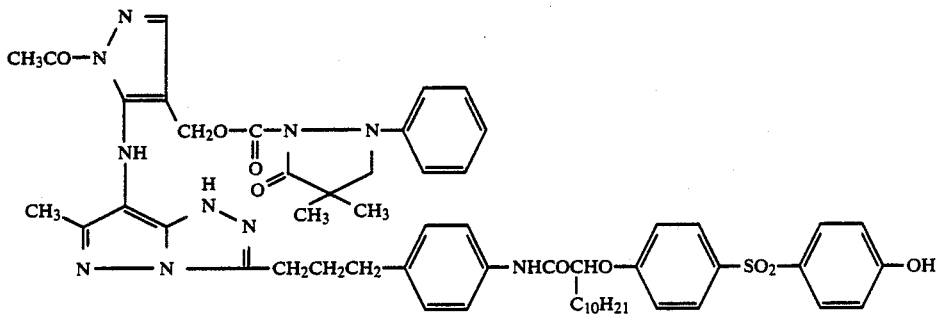
12.
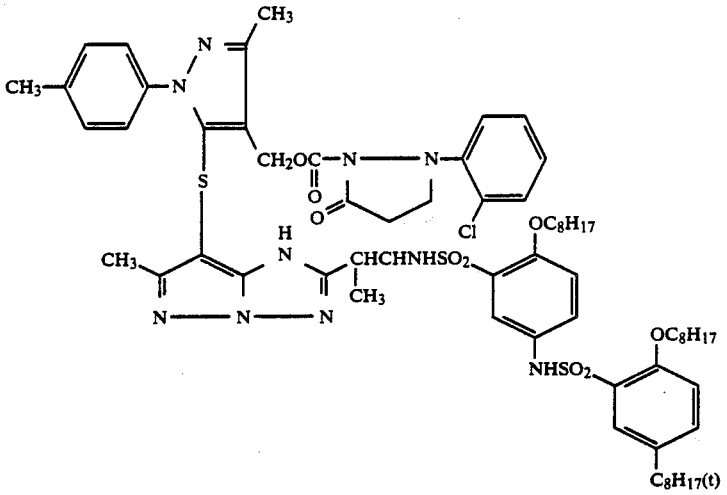
13.
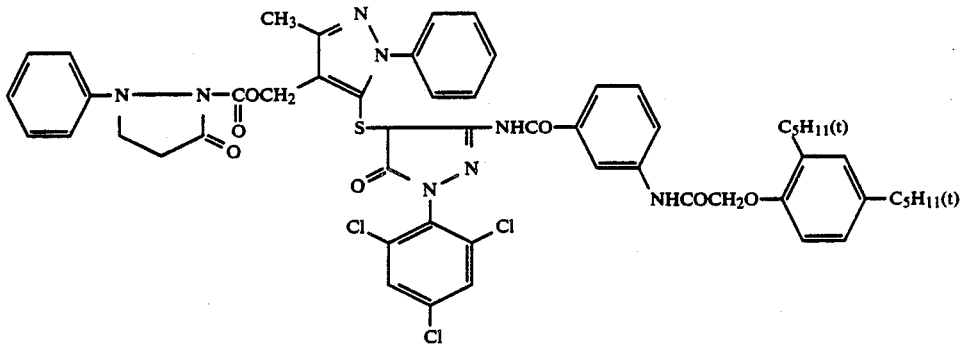

-continued
14.
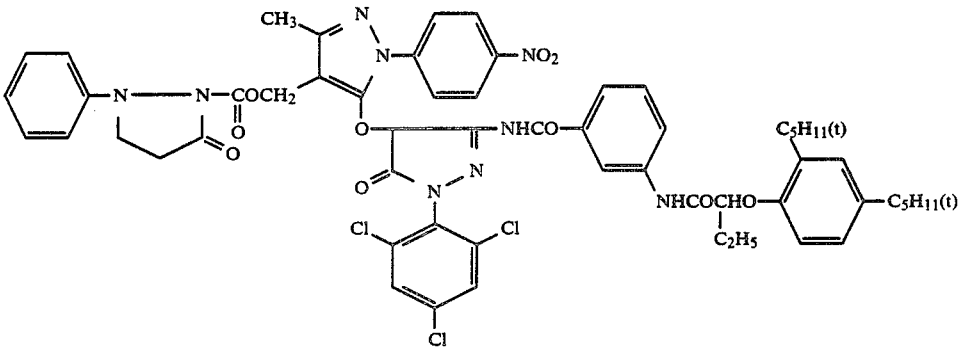
15.
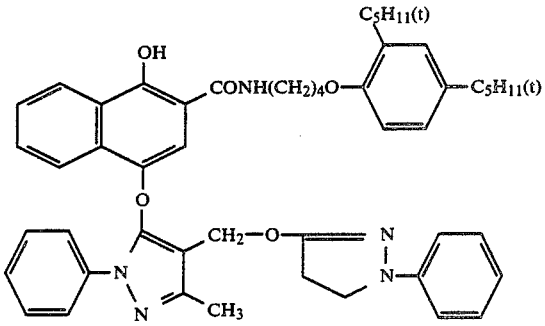
16.
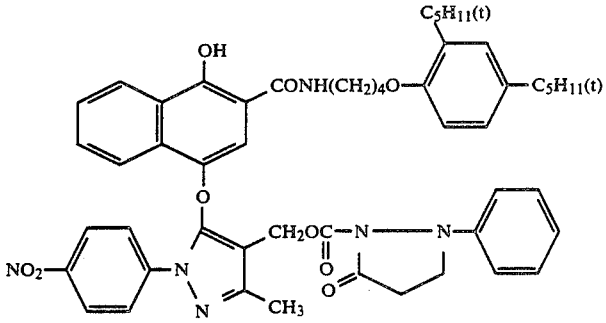
17.
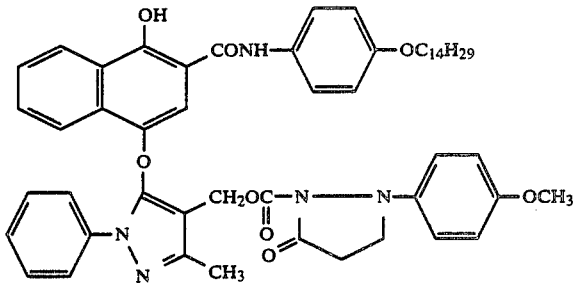
18.
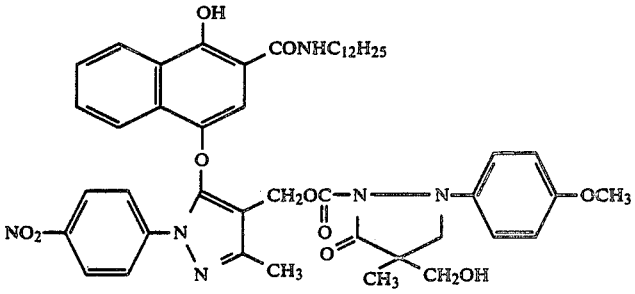

-continued
19.
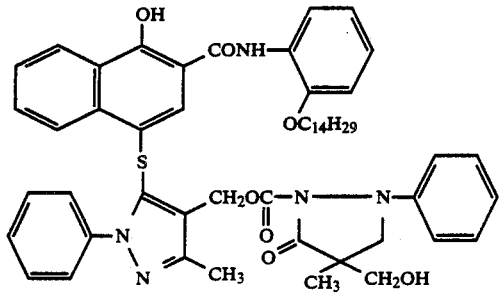
20.
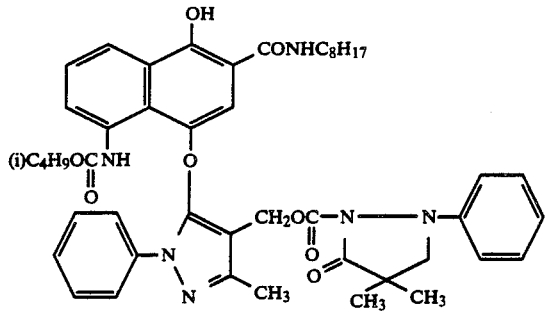
21.
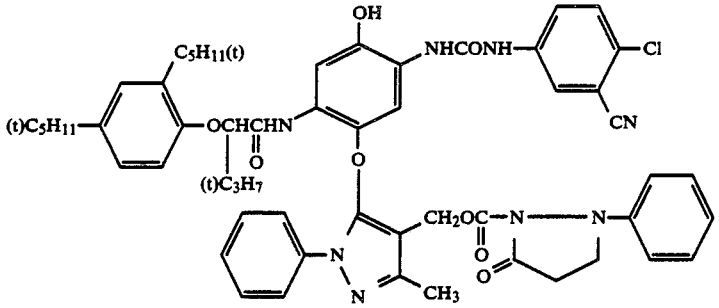
22.
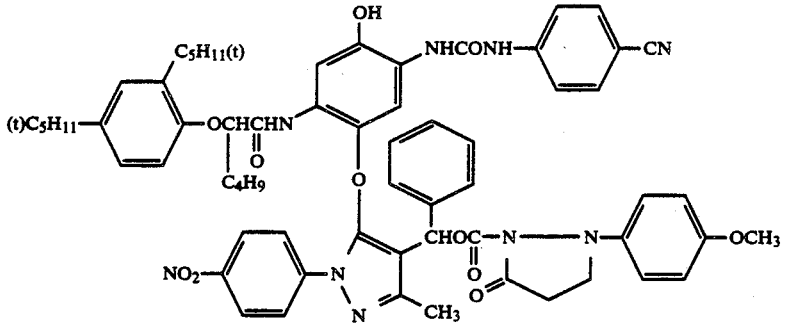
23.
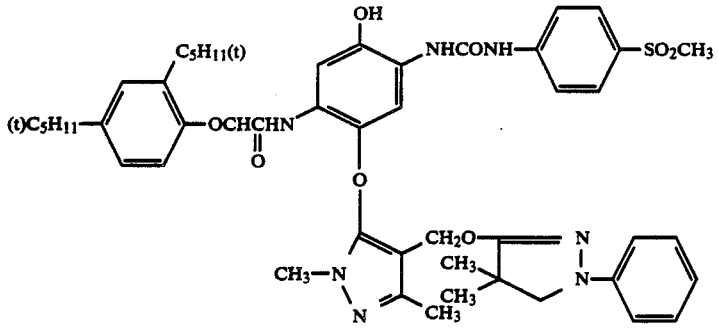
* * * * *